US006145775A

United States Patent [19]

Oberstrass et al.

[11] Patent Number: 6,145,775

[45] Date of Patent: Nov. 14, 2000

[54] YARN WINDING APPARATUS AND METHOD

[75] Inventors: Detlev Oberstrass, Velbert; Peter Dammann, Remscheid, both of Germany

[73] Assignee: Barmag AG, Remscheid, Germany

[21] Appl. No.: 09/191,731

[22] Filed: Nov. 13, 1998

[30] Foreign Application Priority Data

Nov. 14, 1997 [DE] Germany ..... 197 50 510
Jun. 2, 1998 [DE] Germany ..... 198 24 593

[51] Int. Cl.[7] ..... B65H 54/553; B65H 65/00; B65H 75/28

[52] U.S. Cl. ..... 242/476.6; 242/125.1; 242/129.51

[58] Field of Search ..... 242/125.1, 476.5, 242/476.6, 129.51, 487.7, 481.4

[56] References Cited

U.S. PATENT DOCUMENTS

| | | | |
|---|---|---|---|
| 2,048,995 | 7/1936 | Clinton | 242/125.1 |
| 2,573,598 | 10/1951 | Perry et al. | 242/125.1 |
| 3,009,662 | 11/1961 | Furst | 242/125.1 |
| 3,118,633 | 1/1964 | Belville | 242/125.1 |
| 3,227,394 | 1/1966 | Parks | 242/125.1 |
| 3,283,489 | 11/1966 | Bakker | 242/125.1 |
| 3,526,348 | 9/1970 | Morrocco, III et al. | 242/487.7 X |
| 3,544,019 | 12/1970 | Lapidas | 242/481.4 |
| 3,790,100 | 2/1974 | Kilduff | 242/125.1 X |
| 3,863,851 | 2/1975 | Sartori | 242/125.1 X |
| 4,102,507 | 7/1978 | Hoffman et al. . | |
| 4,106,711 | 8/1978 | Oswald et al. | 242/487.7 X |
| 4,116,394 | 9/1978 | Smith et al. | 242/487.7 X |
| 4,299,357 | 11/1981 | Munker | 242/476.6 |
| 4,354,642 | 10/1982 | Schewe | 242/129.51 X |
| 4,948,057 | 8/1990 | Greis | 242/481.4 X |
| 5,169,080 | 12/1992 | Bartkowiak . | |
| 5,248,103 | 9/1993 | Polnik | 242/476.6 |
| 5,263,656 | 11/1993 | Raasch | 242/476.6 X |
| 5,634,602 | 6/1997 | Gobbels et al. | 242/487.7 X |
| 5,639,037 | 6/1997 | Marangone et al. | 242/481.8 X |
| 5,678,778 | 10/1997 | Kotzur et al. | 242/474.4 |
| 5,740,981 | 4/1998 | Haak | 242/413.5 |
| 5,803,394 | 9/1998 | Kotzur et al. | 242/474.4 X |
| 5,918,829 | 7/1999 | Fah | 242/481.4 |

FOREIGN PATENT DOCUMENTS

| | | |
|---|---|---|
| 0477787 | 4/1992 | European Pat. Off. . |
| 535435 | 2/1955 | France . |
| 2349013 | 4/1975 | Germany . |
| 35 16 522 | 11/1985 | Germany . |
| 43 34 813 | 5/1994 | Germany . |
| 2 026 049 | 1/1980 | United Kingdom . |

*Primary Examiner*—Donald P. Walsh
*Assistant Examiner*—Collin A. Webb
*Attorney, Agent, or Firm*—Alston & Bird LLP

[57] ABSTRACT

A yarn winding apparatus and a method for winding a continuously advancing yarn on a driven tube. A bobbin tube is clamped between two clamping plates that are rotatably supported on a package holder, and one of the clamping plates includes in its front edge facing the tube a catching slot with a catching nose that is directed in the direction of rotation, and a clamping slot for clamping the yarn. For purposes of threadup, the yarn is guided by a yarn guide and a suction device to the front edge of the clamping plate in such a manner that the yarn and the clamping plate move essentially in the same direction. To guide the yarn after having dropped into the catching slot, reliably to a lead-in plane of the clamping slot, the clamping plate has in its front edge a recess which undercuts the catching nose and the catching slot and forms a guiding edge on the edge of the clamping plate.

19 Claims, 5 Drawing Sheets

YARN WINDING APPARATUS AND METHOD

BACKGROUND OF THE INVENTION

The present invention relates to a yarn winding apparatus and method for winding a continuously advancing yarn on a driven tube so as to form a wound package.

EP 0 477 787 discloses a method and apparatus of the described type, wherein a continuously advancing yarn is threaded onto a driven tube. In this apparatus, the tube is held between two clamping plates, and the clamping plates are rotatably mounted on a package holder. On the side facing the tube, the clamping plates each have a centering extension which is conical and extends into the end of the tube. Thus, the tube is centered.

Before the winding is started, the continuously advancing yarn is removed by means of a suction device. To thread the yarn on the tube, the yarn guide is moved with the yarn such that the yarn is caught by one of the clamping plates. To this end, a catching slot with a catching nose inclined in the circumferential direction is formed in the edge region of the clamping plate. After the yarn is caught by the catching nose, it is clamped and cut.

To enable a reliable and rapid catching of the yarn, it is necessary that the yarn enter into the catching slot such that it slides under the catching nose. To this end, the known winding apparatus is provided with a drop-in slot in the clamping plate. In the rotational direction of the clamping plate, this drop-in slot precedes the clamping slot. However, it must also be ensured that loopings generated by the yarn as a result of deflections do not lead, in relation to the winding tension, to any major tension fluctuations in the yarn, which would result in the formation of laps on preceding feed elements.

It is therefore an object of the invention to further develop a winding apparatus and method of the initially described kind, which ensures a reliable catching of the yarn while the yarn is guided as gently as possible at the same time.

SUMMARY OF THE INVENTION

The above and other objects and advantages of the present invention are achieved by the provision of a yarn winding apparatus which comprises a bobbin tube mounting device which comprises a holder for rotatably supporting a bobbin tube and which includes a pair of clamping plates for clamping the bobbin tube therebetween. A drive is provided for rotating the bobbin tube and the clamping plates, and at least one of the clamping plates includes a front peripheral edge facing the tube and which has a catching slot and a catching nose extending from the catching slot in the intended direction of rotation of the one clamping plate. The one clamping plate also has a circumferentially extending clamping slot, and a recess undercutting the catching slot and the catching nose which defines a guiding surface which communicates with the peripheral edge. The guiding surface extends in a direction opposite to the intended direction of rotation to a lead-in plane which intersects the clamping slot. Thus upon rotation of the bobbin tube and the clamping plates in the intended direction of rotation, a yarn positioned to engage the front peripheral edge of the one clamping plate will drop into the catching slot and be looped about and caught by the catching nose, and the yarn will then be guided by the guiding surface into the clamping slot.

The yarn is guided by a yarn guide mounted upstream of the bobbin tube so as to be moveable by a drive along a direction parallel to the axis of the bobbin tube, and a suction device is positioned downstream of the bobbin tube. Thus a yarn which is fed into the suction removal device may be guided by the movable yarn guide into contact with the front peripheral edge of the one clamping plate so as to be caught thereby.

During the yarn catching, the yarn and the clamping plate move in essentially the same direction. Thus, the yarn advances substantially obliquely over the front edge of the clamping plate and will enter into the catching slot directly after reaching the catching nose. As a result of the equidirectional movement, the yarn is not expected to slide out of the catching slot. The yarn is caught with great reliability by the nose. As a result of the configuration of the clamping plate in accordance with the invention, it is further accomplished that the yarn is clamped in the clamping slot already after a partial rotation of the clamping plate, without the yarn guide changing its position. The guiding edge formed on the periphery of the clamping plate causes the partial length of the yarn between the nose and the yarn guide to enter into the clamping slot, as the clamping plate rotates. As soon as the yarn is clamped, it is possible to move the yarn guide from its position to wind a yarn reserve on the tube or to transfer the yarn to a traversing yarn guide.

By designing the yarn guide so as to be moveable along an axis parallel to the axis of the bobbin tube it is possible to guide the yarn by the yarn guide to the front edge of the clamping plate already with little deflection and accordingly few loopings. In addition, the yarn guide can be moved in a simple manner, for example, by a linear drive. In the embodiment of the winding apparatus according to the invention, it is preferred to arrange the suction device on the side of the tube facing away from the yarn traversing device. In this arrangement, it is possible to minimize the deflection of the yarn by a suction device that is arranged, if possible, in the region of the tube end.

Each of the clamping plates preferably includes a conical centering extension that extends into the bobbin tube, and the clamping slot is formed between the adjacent end edge of the tube and a recess formed in the centering extension of the one clamping plate. Also, the guiding surface may be made substantially helical opposite the direction of rotation and toward the tube end edge. Thus during a package doff, the yarn clamped between the tube edge and the centering extension of the clamping plate is directly released when the tube is separated from the clamping plate, thereby preventing any disruptions as the package rolls off, since the yarn is unable to remain caught on the clamping plate. In addition, this embodiment allows to accomplish that the loose yarn end has a defined and always unchanged free length. The recess in the centering extension may be in the form of a groove, indent, or flattening.

To ensure that the yarn enters reliably into the clamping slot and is reliably clamped, the clamping slot may be formed between a radially directed, steep clamping flank of the recess and the tube edge. The clamping flank extends oppositely to the direction of rotation, substantially helically on the centering extension from a larger centering diameter toward a smaller centering diameter. Thus, a clamping slot is formed that constantly narrows oppositely to the direction of rotation.

The recess may be formed by a cutout having, when axially sectioned, an L-shape which extends over a pitch circle with the smaller centering diameter. This configuration serves to provide that the yarn slides directly below the tube edge as it enters into the clamping slot.

The recess preferably extends on a centering extension over an angular range of 60° to 120°, with the recess in the front peripheral edge of the clamping plate and the recess in the centering extension overlapping each other. This provides that the yarn may be caught and clamped already during a partial rotation of the clamping plate.

The catching of the yarn and the clamping of the yarn may occur in different planes. With that, it is accomplished that the yarn is safely held in the catching groove.

In a preferred embodiment of the winding apparatus according to the invention, a stationary cutter is provided to cut the yarn. To this end, the partial length of the yarn between the catching nose and the suction device is automatically inserted into the cutter by the rotation of the clamping plate.

To cut the yarn reliably, the cutter is provided with a lead-in edge and a step formed therein that directly precedes the cutting blade. With this arrangement, it is accomplished that the yarn is imparted a motional impulse shortly before arriving at the cutting blade.

The movement of the yarn guide and the position of the catching slot can be adapted to each other by means of a sensor such that it is possible to increase on the one hand the catching reliability and to decrease on the other hand considerably the time, during which the yarn is deflected.

In this instance, it will be especially advantageous, when the sensor is a pulse generator. This pulse generator makes it possible to determine from the pulse sequence both the position and the rotational speed of the tube. In this connection, is especially important to determine the rotational speed of the clamping plate, since after a package doff the empty tube must first be accelerated to the speed necessary for winding. Thus, as a result of the sensing, it is possible that directly after reaching the required rotational speed of the clamping plate, the yarn guide places the yarn for catching on the front edge of the clamping plate.

The yarn guide may be configured to also serve as the traversing yarn guide of a traversing device. This has the advantage that no additional control unit is needed for controlling the yarn traversing device. All operations during the winding, during the package doff, and during the catching are controlled by means of a controller of the traversing device.

After the yarn is caught and initial layers thereof are wound on the tube, the actual winding cycle starts, i.e., the winding of the package. Once the package is fully wound, the suction device takes over the yarn for initiating the package doff. The traversing yarn guide that guides the yarn stops in a transfer position. After the package is doffed, and an empty tube is clamped between the clamping plates in the package holder, the threadup of the yarn begins. To this end, the tube is initially accelerated to a rotational speed required for the threadup. As soon as the rotational speed is reached, the drive of the traversing yarn guide is activated, and the traversing yarn guide guides the yarn to a catching position, in which the yarn advances obliquely over the front edge of the clamping plate.

BRIEF DESCRIPTION OF THE DRAWINGS

In the following, the winding apparatus and method of the present invention are described in more detail with reference to the attached drawings, in which.

DETAILED DESCRIPTION OF THE PREFERRED EMBODIMENTS

Figure 1:
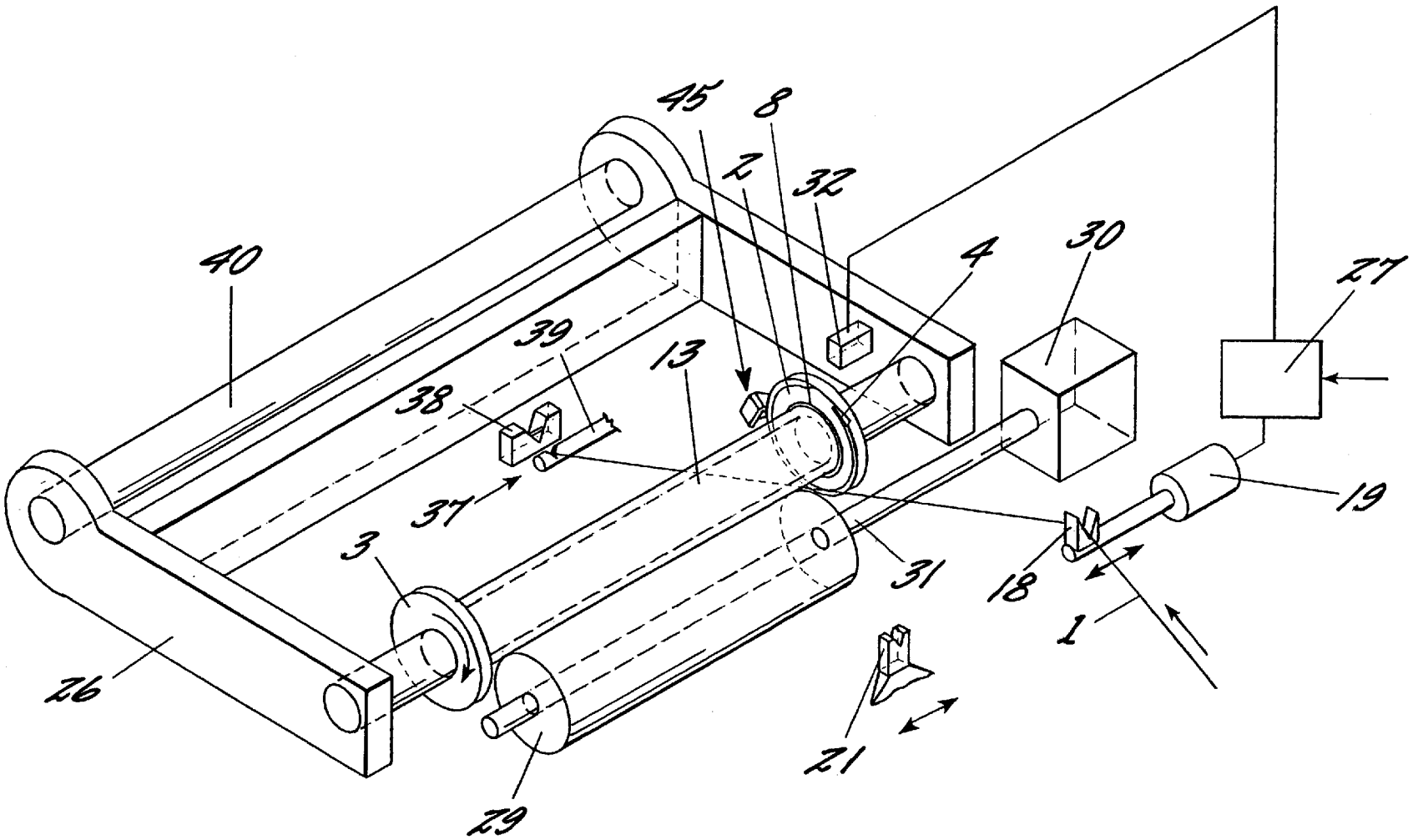
FIG. 1 is a schematic view of a yarn winding apparatus while threading the yarn.

FIG. 1 shows a first embodiment of a yarn winding apparatus in accordance with the invention, as may be used, for example, in a texturing machine. A package holder 26 is mounted for rotation about a swing axle 40 secured in a machine frame 41. Supported for rotation on the free ends of the fork-shaped package holder 26 are two opposite clamping plates 2 and 3. Between the clamping plates 2 and 3, a bobbin tube 13 is held for receiving a package. To this end, the clamping plates 2 and 3 have each a conical centering extension 8, which extends in part into the tube end. Thus, the tube 13 is centered between the clamping plates 2 and 3. A drive roll 29 lies against the surface of tube 13. The drive roll 29 is mounted on a drive shaft 31, which is connected at its one end to a motor 30. The drive roll motor 30 drives the drive roll 29 at a substantially constant speed. The drive roll 29 in frictional engagement with tube 13 accelerates same to a winding speed which facilitates threading and winding of the yarn at the yarn speed. Thus, the winding speed remains substantially constant during the winding cycle. Upstream of drive roll 29, a traversing yarn guide 21 is arranged, which is connected to a drive which oscillatingly drives the traversing yarn guide within a winding range. The drive may, for example, be a cross-spiralled roll or a belt drive.

Between the traversing yarn guide 21 and the tube 13, a movable yarn guide 18 is arranged. The yarn guide 18 is connected to a drive 19, which reciprocates the yarn guide 18 in a plane parallel to the tube 13. The drive 19 is connected to a controller 27. The controller 27 connects to a sensor 32 that is arranged on the package holder 26. The sensor 32 is arranged in the region of clamping plate 2 and senses the position of a catching slot 4 in clamping plate 2.

The sensor 32 may be a pulse generator which releases per revolution a signal as a function of the catching slot 4. These pulses are converted in the controller 27 for evaluating the position of the catching slot and the rotational speed of tube 13. The tube 13 is clamped between clamping plates 2 and 3 in such a manner that the clamping plate 2 and 3 rotate without slip at the rotational speed of the tube.

On the side opposite to the traversing device and drive roll 29, a suction device 37 is arranged. This suction device consists of a cutter 38 and a suction inlet end 39.

In the embodiment shown in FIG. 1, a package has already been doffed, and the continuously advancing yarn is taken in by the suction device 37. The yarn 1 is continuously removed through suction inlet end 39 by means of a suction current. To thread the yarn on the empty tube 13 for winding same thereon, the yarn 1 is guided upstream of the suction device by yarn guide 18. The yarn guide 18 which has taken over the yarn from traversing yarn guide 21 is guided by drive 19 to a threading position. This threading position of yarn guide 18 is selected such that the yarn 1 advances obliquely over the front edge of clamping plate 2, which faces the tube. Before that, the tube 13 in circumferential contact with drive roll 29 is accelerated to a winding speed that is predetermined by the drive roll. After each passing of the catching groove, the sensor 32 generates a pulse which is supplied to controller 27. The controller 27 includes an evaluation unit which determines from the pulses entering per unit time the momentary rotational speed of clamping plate 2 and, thus, of tube 13. At the same time, each pulse indicates the position of the catching slot 4. After the tube 13 has reached the winding speed, and a catching slot 4 is in the position required for a reliable catching, controller 27 activates drive 19, so as to move yarn guide 18 to its threading position. The yarn 1 is now caught by clamping plate 2.

Figure 2:
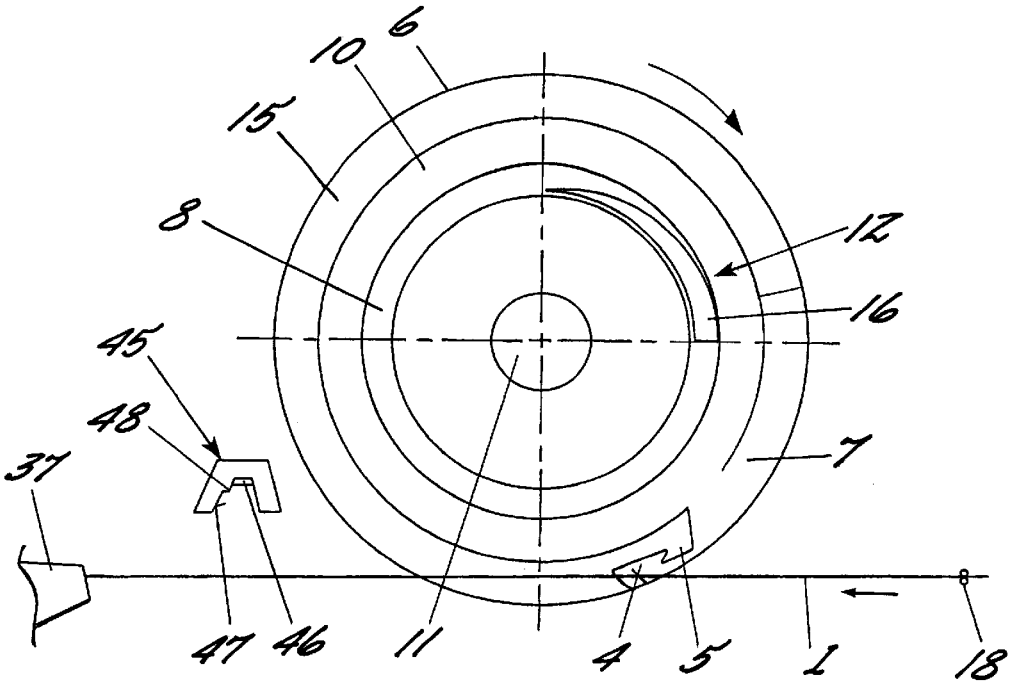
FIG. 2 is a schematic front view of the clamping plate in the winding apparatus of FIG. 1 without a tube.
Figure 3:
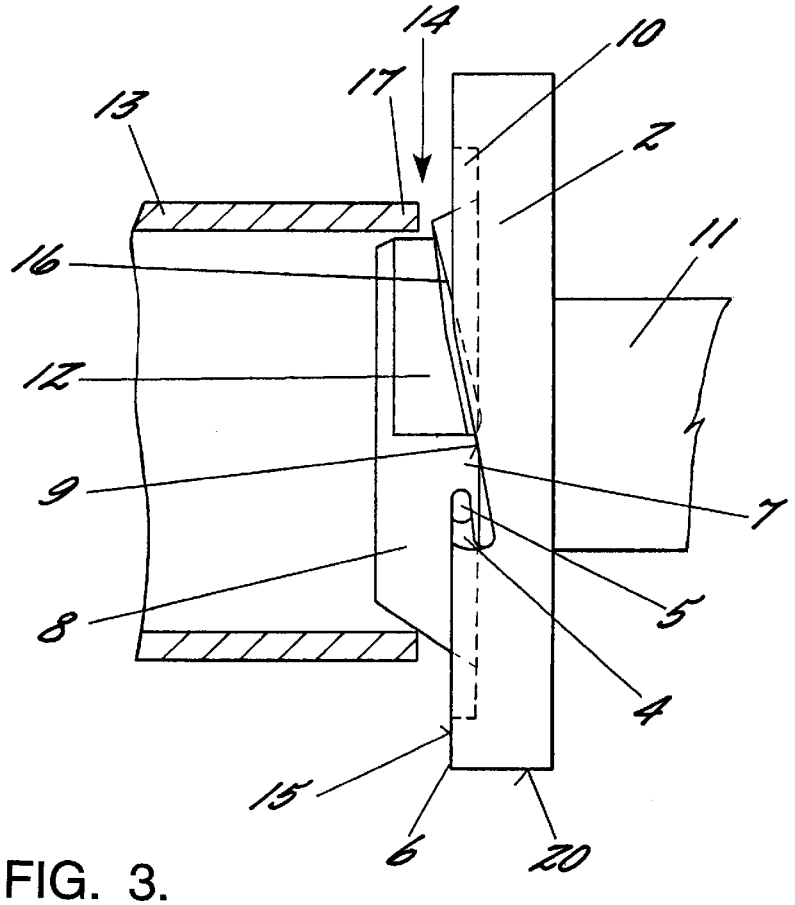
FIG. 3 is a schematic side view of the clamping plate of FIG. 2 with a tube cut lengthwise.
Figure 3A:
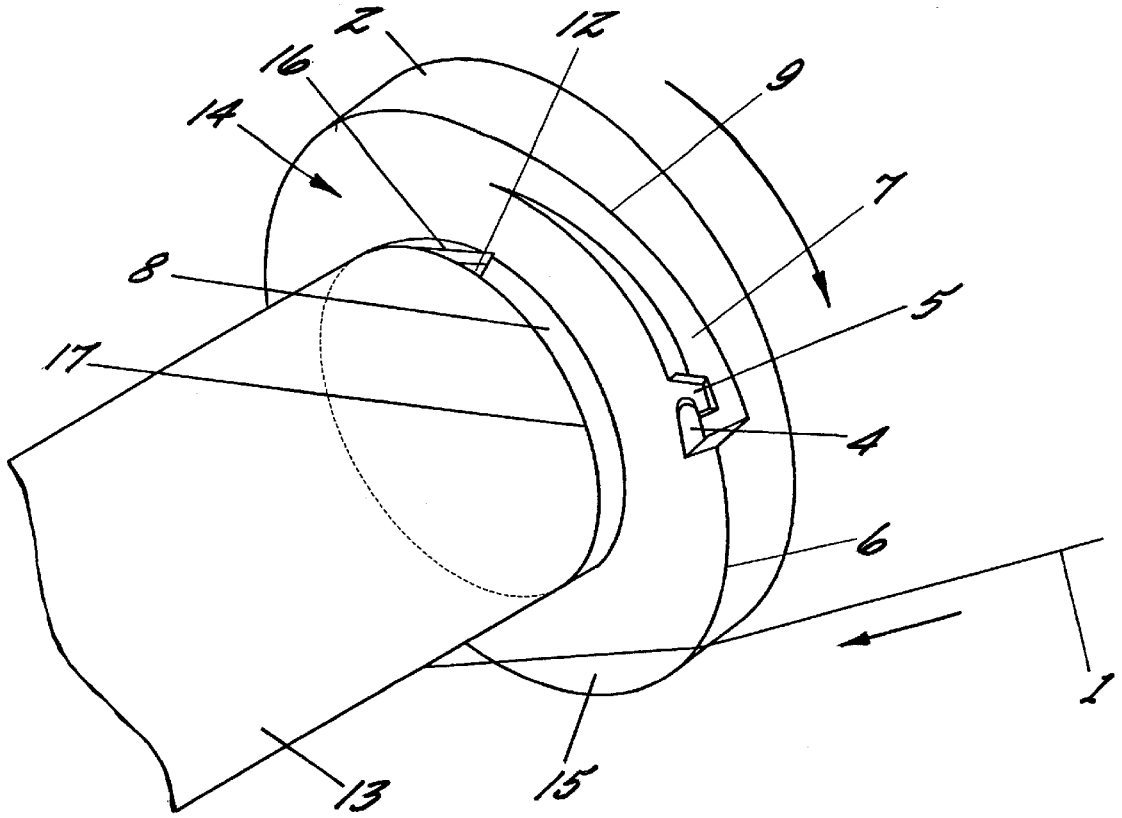
FIG. 3*a* is a perspective view of the clamping plate shown in FIGS. 2 and 3, with the cutout 10 omitted.

To this end, the clamping plate includes a catching slot 4 and a peripherally overlapping catching nose 5, as shown in FIGS. 2, 3, and 3*a*. The following description thus applies in like manner to FIGS. 2, 3, and 3*a*, which are each a schematic view of clamping plate 2 of the winding apparatus shown in FIG. 1. The clamping plate 2 is supported with its shaft 11 for rotation in the package holder. The clamping plate 2 has on its side facing the tube a conical centering extension 8. This centering extension 8 holds the tube 13 by its edge.

On its side facing the tube 13, the clamping plate 2 has an annular front edge 6 which has a larger diameter than the tube diameter. The front edge 6 is formed by a circumferential surface 20 and an annular front surface 15. On the side of clamping plate 2 that faces tube 13, a cutout 10 is provided in the clamping plate between the annular front surface 15 and the centering extension 8. As a result, the front surface 15 extends in a normal plane of the centering extension 8. The front edge 6 is interrupted in the circumferential direction by catching slot 4 and catching nose 5, as well as a recess 7 which is machined out of front surface 15. The catching slot 4 and catching nose 5 are machined out of front surface 15. The catching nose 5 has a projection that is inclined in the direction of rotation of the clamping plate.

The recess 7 is machined out of the front surface 15 to a depth that decreases oppositely to the direction of rotation. In the region of catching slot 4 and catching nose 5, the recess 7 is shaped in such a manner that it undercuts the catching slot 4 and catching nose 5. On the edge of clamping plate 2, the recess 7 has a guiding surface 9 that is formed with circumferential surface 20. Based on the shape of recess 7, the guide edge is made substantially helical toward the tube edge, until it progressively merges into the front edge 6 at the end of recess 7.

In the region of transition from the guiding surface 9 to the front edge 6, the circumferential surface of centering extension 8 contains a recess 12 in the form of an L-shaped cutout having a cylindrical flank which has a diameter that is smaller than the tube diameter, note FIG. 3. In this connection, the cutout also forms a substantially radially directed clamping flank 16. In the axial direction, the depth of recess 12 decreases oppositely to the direction of rotation of clamping plate 2. Thus, the clamping flank 16 extends on the centering extension substantially helically from a larger centering diameter to a smaller centering diameter immediately adjacent the edge of the tube. Thus, a clamping slot 14 is formed between the tube edge 17 and the clamping flank 16. The clamping slot 14 has a width that decreases oppositely the direction of rotation. The maximum depth of recess 12 in the centering extension 8 is selected such that the recess 12 extends through the normal plane of front surface 15. In this instance, the normal plane forms a lead in plane in which the yarns enters into the clamping slot.

As shown in FIGS. 1 and 2, a cutter 45 is arranged on side of the suction device 37 in the vicinity of clamping plate 2. The cutter 45 has a lead-in edge 47 which is bounded by a cutting blade 46. The lead-in edge 47 has a step 48 at a short distance from the cutting blade 46.

Figure 4:
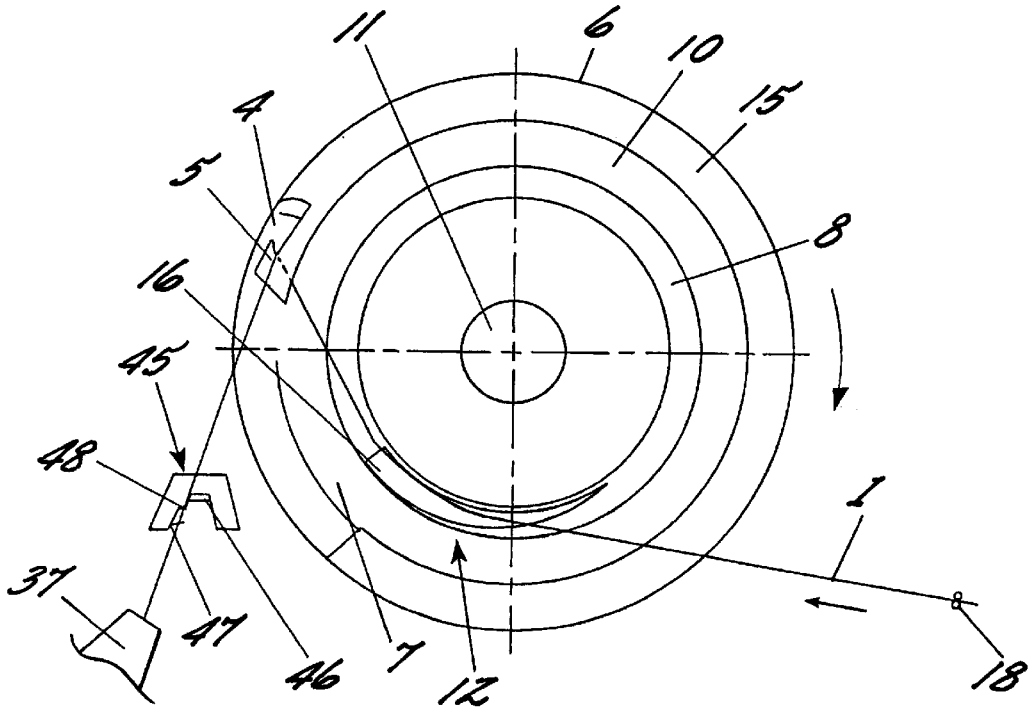
FIG. 4 is a schematic front view of the clamping plate of FIG. 2 with a caught yarn.

In the following, the threadup of the yarn in the winding apparatus shown in FIG. 1 is described in more detail with reference to FIGS. 2–4. As shown in FIGS. 1 and 2, the yarn 1 is initially deflected by the movement of yarn guide 18 in such a manner that the yarn advances obliquely over the front edge 6 of clamping plate 2. In this process, the yarn enters continuously into the suction device 37. As shown in FIGS. 2 and 3*a*, the direction of the advancing yarn and the rotational direction of clamping plate 2 are equidirectional. As soon as the catching slot 4 and the yarn 1 coincide due to the rotation of clamping plate 2, the yarn 1 drops into catching slot 4 and deflects on the guiding surface 9 of recess 7. As the clamping plate 2 continues to rotate, the yarn 1 reaches the projection of catching nose 5, and as a result of the continuing rotation of clamping plate 2, the yarn 1 deflects on catching nose 5. In so doing, the partial length of the yarn between yarn guide 18 and catching nose 5 slides along guiding surface 9 and enters in the lead-in plane into clamping slot 14. As shown in FIG. 4, along with the continuing rotation of clamping plate 2, the partial length of yarn 1 between catching nose 5 and yarn guide 18 is clamped between the tube edge 17 and clamping flank 16. Directly thereafter, the yarn length between catching nose 5 and suction device 37 arrives at the cutter 45. In so doing, the yarn 1 slides along lead-in edge 47 to cutting blade 46. The step 48 causes an accelerated drop of the yarn 1 onto cutting blade 46. The yarn 1 is cut, and the threadup operation is completed. Thus, the yarn is reliably caught by the clamping plate 2 already after a partial rotation over an angular range from 120° to 270°.

The clamping plate 2 shown in FIGS. 2–4 is an exemplified embodiment. Thus, the front edge 6 and guiding edge 9 may be rounded or flattened for a better yarn advance. Furthermore, the recess in the circumferential surface of the centering extension may be formed by a groove or a flat. However, it is also possible to arrange the clamping slot directly in the catching nose or in a peripheral groove in the clamping plate. Likewise, the cutting blade may be accommodated in a groove of the clamping plate.

Figure 5:
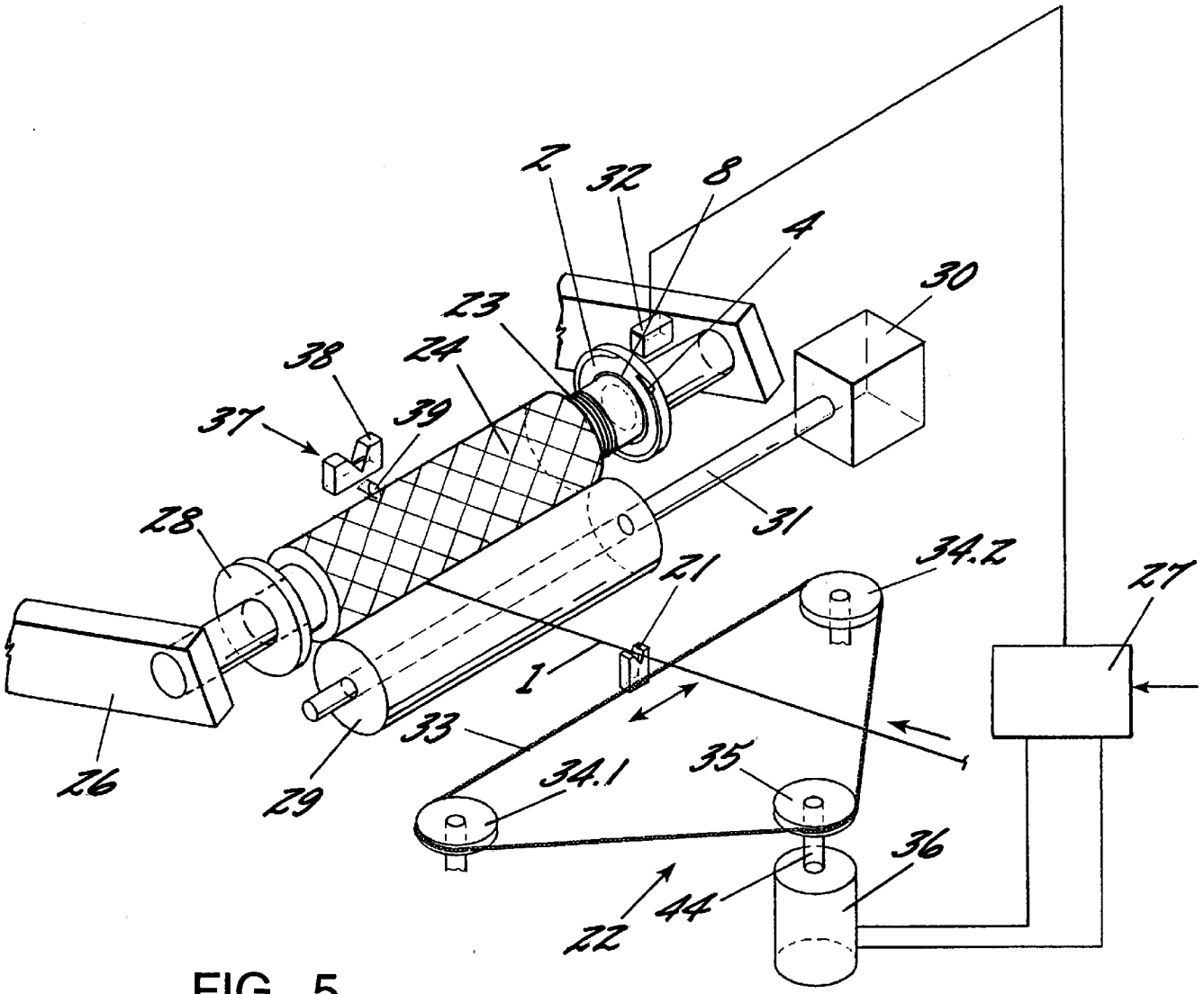
FIGS. 5 and 6 each show a further embodiment of a winding apparatus according to the invention.
Figure 6:
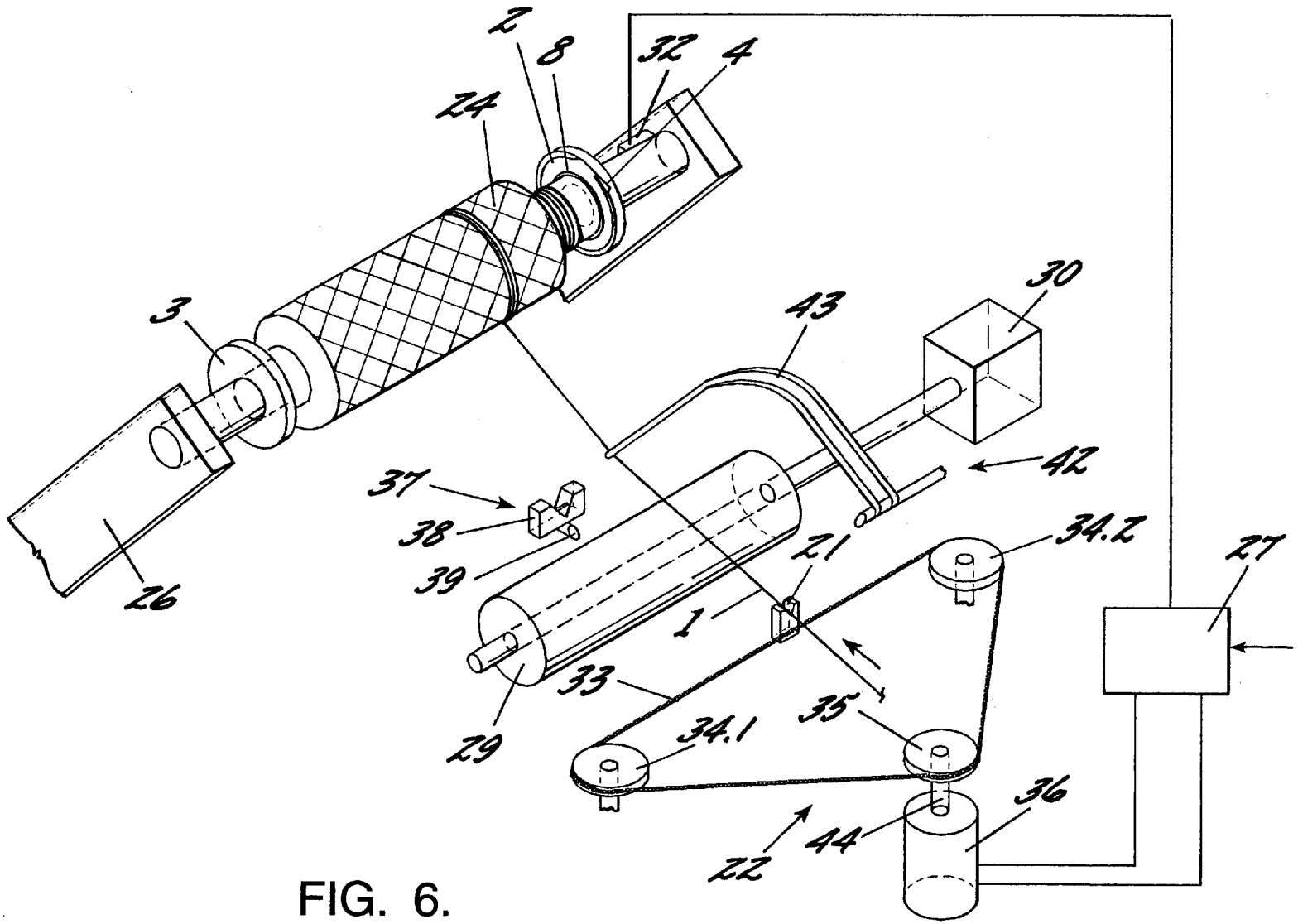

FIGS. 5 and 6 show a further embodiment of the winding apparatus in accordance with the invention. In this embodiment, the yarn 1 is guided, for purposes of threading, by the traversing yarn guide 21. Since the construction of the winding apparatus differs from that shown in FIG. 1 only by its yarn traversing device, structural components of the same functions are identified by the same numerals. To this extent, the description of FIG. 1 is herewith incorporated by reference.

A traversing device 22 is constructed as a so-called belt-drive traversing system, wherein a traversing yarn guide 21 is mounted on an endless belt 33. The belt 33 is guided between two deflection pulleys 34.1 and 34.2 parallel to the tube 13. In the belt plane, a drive pulley 35 partially looped by the belt is arranged parallel to the deflection pulleys 34.1 and 34.2. The drive pulley 35 is mounted on a drive shaft 44 of an electric motor 36. The electric motor 36 drives the drive pulley 35 oscillatingly, so that the traversing yarn guide 21 is reciprocated in the region between the deflection pulleys 34.1 and 34.2. The electric motor is controllable via controller 27. The controller 27 connects to the sensor 32 arranged on package holder 26. The sensor 32 senses the catching slot 4 in clamping plate 2. In FIGS. 5 and 6, the winding apparatus is shown in different operating situations.

The threadup of the yarn on tube 13 or clamping plate 2 occurs in a manner analogous to the previously described embodiment. In the place of yarn guide 18, the traversing yarn guide 21 is moved by means of controller 27 and electric motor 36 to a catching position. The threadup operation occurs in the same manner as previously described with reference to FIGS. 2–4, and is herewith incorporated by reference.

In FIG. 5, the threadup operation has already been completed, and the winding cycle has started. To this end, the traversing yarn guide 21 has previously been guided from its catching position to the winding range. In this process, the yarn 1 is wound to a yarn reserve 23 on the tube 13 outside the winding range. The winding of a yarn reserve 23 may in this instance occur by traversing yarn guide 21 that remains in one position. Thus, the yarn reserve has a number of parallel winds. However, the traversing yarn guide 21 may also be guided to the winding range at a speed that is defined by the motor 36, so that side-by-side winds are produced in the yarn reserve wind. As soon as the yarn guide reaches the winding range, the winding cycle starts. The traversing yarn guide is then reciprocated by the traversing device 22 within the winding range. The increasing diameter of a package 2 is facilitated by a swing movement of the package holder 26. To this end, the package holder 26 has biasing means (not shown), which generate between the package 24 and drive roll 29 on the one hand a contact pressure that is necessary for the drive of the package, and which facilitate on the other hand a swing movement of the package holder 26.

FIG. 6 shows a winding apparatus at the end of a winding cycle. After the package 24 is fully wound, the traversing yarn guide 21 is moved to a transfer position. In this transfer position, the traversing yarn guide 21 remains stopped. On the package 24, a tie-off wind is wound. At the same time, the package holder 26 swings with the package 24 out of the operating position. A transfer device 42 starts to operate simultaneously, in that a gripping arm 43 engages the yarn advancing between the full package 24 and the traversing yarn guide 21. The gripping arm 43 swings from an idle position to a transfer position. In the transfer position, it engages the yarn 1 and guides same in the transfer position to the suction device 37. In the cutter 38, the yarn is then cut and removed via suction inlet end 39. The loose yarn end is deposited on the package in the region of the tie-off wind. Now, the package, may be replaced with an empty tube. In this connection, it will be advantageous, when the sensor is mounted to the package holder, and thus a standstill of the package is signalled in that the sensor discontinues to generate a pulse. The sensor signal may thus be used to activate a doffing device. After the package 24 has been replaced with a tube, the sequence of the threadup starts anew.

What is claimed is:

1. A yarn winding apparatus for winding a continuously advancing yarn into a yarn package, comprising a bobbin tube mounting device which comprises a holder for rotatably supporting a bobbin tube and which includes a pair of rotatably supported clamping plates for clamping the bobbin tube therebetween, a device for rotating the bobbin tube and the clamping plates, at least one of said clamping plates including a front peripheral edge facing the tube and which has a catching slot and a catching nose extending from the catching slot in the intended direction of rotation of the one clamping plate, and a circumferentially extending clamping slot, and a recess undercutting the catching slot and the catching nose so that the recess defines a guiding surface which communicates with the front peripheral edge, with the guiding surface extending away from said catching nose in a direction opposite to the intended direction of rotation to a lead in plane which intersects the clamping slot, wherein each of said clamping plates includes a centering extension that extends into the bobbin tube, wherein the clamping slot is formed between the adjacent end edge of the bobbin tube and a recess formed in the centering extension of the one clamping plate, and wherein the guiding surface extends helically toward the adjacent end edge of the bobbin tube, whereby, upon rotation of the bobbin tube and the clamping plates in the intended direction of rotation, a yarn positioned to engage the front peripheral edge of the one clamping plate will drop into the catching slot and be looped about and caught by the catching nose, and the yarn will then be guided by the guiding surface into the clamping slot.

2. The yarn winding apparatus as defined in claim 1 further comprising a yarn guide mounted upstream of the bobbin tube so as to be moveable by a drive along a direction parallel to the axis of the bobbin tube, and a suction device which is located downstream of the bobbin tube, whereby a yarn which is fed into the suction device may be guided by the movable yarn guide into contact with a portion of the front peripheral edge of the one clamping plate such that the yarn advances obliquely with respect to the direction of rotation of the clamping plate and the yarn may be caught thereby.

3. The yarn winding apparatus as defined in claim 2 further comprising a cutter arranged between the one clamping plate and the suction device such that the caught yarn can be guided by the catching nose into the cutter during the rotation of the one clamping plate.

4. The yarn winding apparatus as defined in claim 3 wherein the cutter has a lead-in edge and a cutting blade arranged at the end of the lead-in edge, and wherein a step is formed in the lead-in edge at a short distance from the cutting blade.

5. The yarn winding apparatus as defined in claim 1 wherein each of said centering extensions is conical.

6. The yarn winding apparatus as defined in claim 1 wherein the recess in the centering extension has a radially directed clamping flank which extends oppositely to the direction of rotation and substantially helically on the centering extension from a larger centering diameter to a smaller centering diameter immediately adjacent the end edge of the tube, so that the clamping slot is formed between the clamping flank and the adjacent end edge of the tube and has an axial width that increases in the direction of rotation.

7. The yarn winding apparatus as defined in claim 6 wherein the recess in the centering extension is formed by a cutout having, when axially sectioned, an L-shape, with one flank of the L-shape comprising said clamping flank and the other flank of the L-shape being a cylindrical surface having a diameter less than that of the bobbin tube.

8. The yarn winding apparatus as defined in claim 7 wherein the recess extends on the centering extension over an angular range from 60° to 120°, with the recess in the front peripheral edge and the recess in the centering extension overlapping each other.

9. The yarn winding apparatus as defined in claim 8 wherein the catching slot in the one clamping plate precedes in the direction of rotation the clamping slot.

10. The yarn winding apparatus as defined in claim 1 wherein said one clamping plate includes a front surface which faces said bobbin tube and is normal to the longitudinal axis defined by the bobbin tube, and wherein said front surface defines said lead-in plane.

11. The yarn winding apparatus as defined in claim 10 wherein said centering extension extends from said front surface.

12. The yarn winding apparatus as defined in claim 1 wherein the drive of the yarn guide is controllable by a controller, and further comprising a sensor for sensing the rotational speed of the bobbin tube and which has an output leading to the controller, whereby the movement of the yarn guide to a yarn catching position is controlled by the sensor.

13. The yarn winding apparatus as defined in claim 12 wherein the sensor is a pulse generator, which signals the position of the catching slot per revolution of the one clamping plate by a pulse to the controller, and that the controller includes an evaluation unit which determines the rotational speed of the tube from the number of pulses per unit time.

14. The yarn winding apparatus as defined in claim 1 wherein the yarn guide is a traversing yarn guide of a traversing device, which traversing yarn guide guides the yarn outside and inside the winding range in the longitudinal direction parallel to the tube, and wherein the traversing yarn guide can be driven in either direction by a variable speed drive.

15. A method of threading a continuously advancing yarn onto a driven bobbin tube which is supported between two rotatably supported clamping plates of a package holder, and wherein at least one of said clamping plates includes a front peripheral edge facing the tube and which has a catching slot and a catching nose extending from the catching slot in the intended direction of rotation of the one clamping plate, and a circumferentially extending clamping slot, comprising the steps of rotating the bobbin tube and the clamping plates to a predetermined winding speed, and guiding the advancing yarn into engagement with the front peripheral edge of the one clamping plate so as to cause the yarn to drop into the catching slot and be looped about and caught by the catching nose, and then guiding the yarn into the clamping slot, and wherein the guiding step includes guiding the yarn into engagement with a portion of the front peripheral edge of the one clamping plate which is moving in essentially the same direction as the advancing yarn.

16. The method as defined in claim 15 wherein the guiding step includes contacting the advancing yarn with a moveable yarn guide upstream of the bobbin tube and guiding the yarn from the yarn guide into a suction device, and so that the advancing yarn runs serially from the yarn guide, into engagement with the front peripheral edge of the one clamping plate, and then into the suction device.

17. The method as defined in claim 16 wherein the guiding step includes guiding the yarn between the yarn guide and the suction device in a direction oblique to the direction of rotation of the front peripheral edge of the clamping plate.

18. The method as defined in claim 17 comprising the further subsequent step of cutting the advancing yarn at a location between the front peripheral edge of the one clamping plate and the suction device.

19. The method as defined in claim 15 wherein the front peripheral edge of the one clamping plate further includes a recess undercutting the catching slot and the catching nose so that the recess defines a guiding surface which communicates with the peripheral edge, with the guiding surface extending in a direction opposite to the intended direction of rotation to a lead-in plane which intersects the clamping slot, and wherein the step of guiding the yarn into the clamping slot includes guiding the yarn along the guiding surface.

* * * * *